US010601174B2

(12) United States Patent
Li et al.

(10) Patent No.: US 10,601,174 B2
(45) Date of Patent: Mar. 24, 2020

(54) ELECTRICAL CONNECTOR ASSEMBLY WITH A LOCKING DEVICE TO STABILIZE THE ELECTRICAL CONNECTION

(71) Applicant: Tyco Electronics (Shanghai) Co. Ltd., Shanghai (CN)

(72) Inventors: Cui Li, Shanghai (CN); Hao Wang, Shanghai (CN); Jianfei Yu, Shanghai (CN); Biao Pan, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/040,729

(22) Filed: Jul. 20, 2018

(65) Prior Publication Data

US 2019/0027862 A1 Jan. 24, 2019

(30) Foreign Application Priority Data

Jul. 21, 2017 (CN) ..... 2017 1 0599689

(51) Int. Cl.

| | |
|---|---|
| ***H01R 13/627*** | (2006.01) |
| ***H01R 13/512*** | (2006.01) |
| ***H01R 13/52*** | (2006.01) |
| ***H01R 13/633*** | (2006.01) |
| *H01R 13/59* | (2006.01) |

(52) U.S. Cl.

CPC ..... *H01R 13/6273* (2013.01); *H01R 13/512* (2013.01); *H01R 13/5221* (2013.01); *H01R 13/633* (2013.01); *H01R 13/5205* (2013.01); *H01R 13/59* (2013.01)

(58) Field of Classification Search

CPC ..... H01R 13/6273; H01R 13/512; H01R 13/5221; H01R 13/633; H01R 13/639; H01R 13/6271; H01R 24/38

USPC ..... 439/157, 345, 352, 357, 358, 271, 322, 439/578, 675

See application file for complete search history.

(56) References Cited

U.S. PATENT DOCUMENTS

| | | | | |
|---|---|---|---|---|
| 5,993,230 | A * | 11/1999 | Gauker | H01R 13/7032 200/51.1 |
| 6,132,234 | A * | 10/2000 | Waidner | H01R 13/6273 439/358 |
| D479,199 | S * | 9/2003 | Jones | D13/147 |
| 7,484,988 | B2 * | 2/2009 | Ma | H01R 13/502 439/350 |

(Continued)

*Primary Examiner* — Travis S Chambers
(74) *Attorney, Agent, or Firm* — Barley Snyder

(57) ABSTRACT

An electrical connector adapted to be mated with a mating electrical connector comprises a housing including a cylinder having a receiving passage extending in an axial direction of the electrical connector, a conductive terminal disposed in the receiving passage, and a locking device. The locking device includes a body portion, a locking portion disposed at a first end of the body portion and configured to engage with a mating locking portion of the mating electrical connector to lock the electrical connector with the mating electrical connector, a releasing portion disposed at a second end of the body portion opposite the first end of the body portion and configured to release the engagement between the locking portion and the mating locking portion, and a flexible connecting arm formed in a curved shape and connecting the body portion to an outer surface of the cylinder.

20 Claims, 9 Drawing Sheets

(56) References Cited

U.S. PATENT DOCUMENTS

| | | | | |
|---|---|---|---|---|
| 7,794,274 | B2 * | 9/2010 | Phillips, Jr. | H01R 13/187 439/578 |
| 8,591,247 | B2 * | 11/2013 | Zhu | H01R 13/6273 439/352 |
| 8,628,252 | B2 * | 1/2014 | Matsumoto | G02B 6/3879 385/56 |
| 8,662,914 | B2 * | 3/2014 | Keswani | H01R 4/4818 439/441 |
| 9,071,019 | B2 * | 6/2015 | Burris | H01R 13/639 |
| 9,774,138 | B1 * | 9/2017 | Peng | H01R 24/20 |
| 10,096,927 | B2 * | 10/2018 | Hashiguchi | H01R 13/422 |
| 10,128,607 | B2 * | 11/2018 | Lane | H01R 13/5219 |
| 2003/0194899 | A1 * | 10/2003 | Ueda | H01R 13/6272 439/357 |
| 2004/0033721 | A1 * | 2/2004 | Pocrass | H01R 9/0524 439/578 |
| 2005/0181653 | A1 * | 8/2005 | Shimizu | H01R 13/6273 439/310 |
| 2007/0054535 | A1 * | 3/2007 | Hall | H01R 13/6272 439/352 |
| 2010/0130070 | A1 * | 5/2010 | Isaac | H01R 13/64 439/680 |
| 2010/0136827 | A1 * | 6/2010 | Chawgo | H01R 9/0503 439/578 |
| 2011/0312206 | A1 * | 12/2011 | Seido | H01R 13/6273 439/352 |

* cited by examiner

ELECTRICAL CONNECTOR ASSEMBLY WITH A LOCKING DEVICE TO STABILIZE THE ELECTRICAL CONNECTION

CROSS-REFERENCE TO RELATED APPLICATION

This application claims the benefit of the filing date under 35 U.S.C. § 119(a)-(d) of Chinese Patent Application No. 201710599689.8, filed on Jul. 21, 2017.

FIELD OF THE INVENTION

The present invention relates to an electrical connector and, more particularly, to an electrical connector having a locking device.

BACKGROUND

For an electrical connector matable with a mating electrical connector, a locking device that locks the electrical connector with the mating electrical connector is generally formed on the electrical connector to stabilize the electrical connection. Because the components of the electrical connector are subject to impact during use, however, the locking device is apt to be damaged and can fail to implement locking and release of the locking. Furthermore, the locking device may break and fail due to the impact, leading to malfunction of the electrical connector.

SUMMARY

An electrical connector adapted to be mated with a mating electrical connector comprises a housing including a cylinder having a receiving passage extending in an axial direction of the electrical connector, a conductive terminal disposed in the receiving passage, and a locking device. The locking device includes a body portion, a locking portion disposed at a first end of the body portion and configured to engage with a mating locking portion of the mating electrical connector to lock the electrical connector with the mating electrical connector, a releasing portion disposed at a second end of the body portion opposite the first end of the body portion and configured to release the engagement between the locking portion and the mating locking portion, and a flexible connecting arm formed in a curved shape and connecting the body portion to an outer surface of the cylinder.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
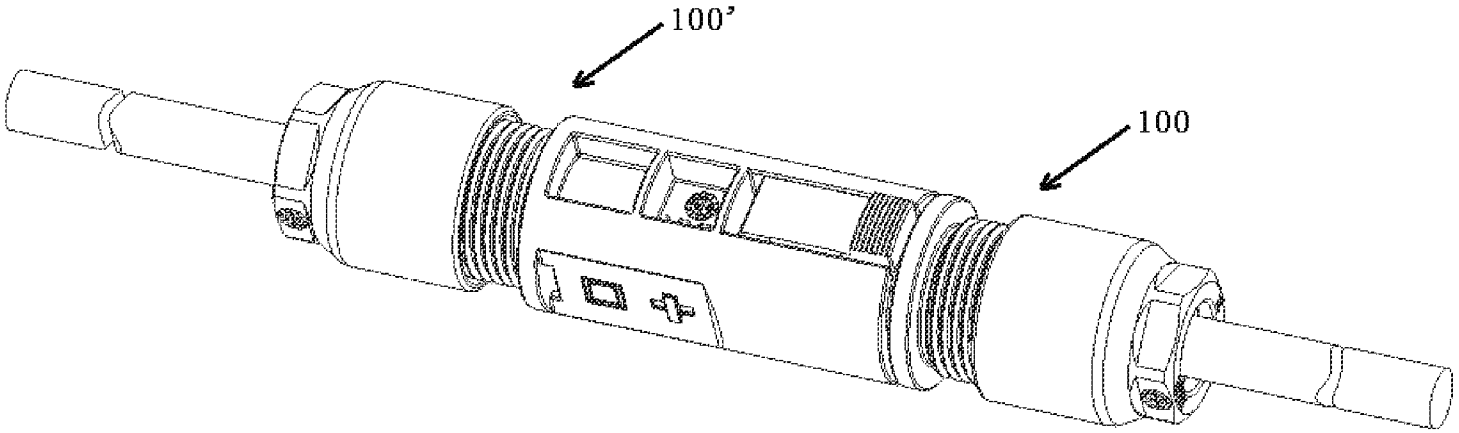
FIG. 1 is a perspective view of an electrical connector assembly according to an embodiment.

The technical solutions of the present disclosure will be further specifically described below through embodiments and with reference to the accompanying drawings. In the description, the same or similar reference numerals designate the same or similar components. The following description of the embodiments of the present disclosure with reference to the drawings is intended to explain the general inventive concept of the present disclosure, and it should not be construed as limiting the present disclosure.

In addition, in the following detailed description, for purposes of explanation, numerous specific details are set forth in order to provide a thorough understanding of the disclosed embodiments. However, it is apparent that one or more embodiments may also be implemented without these specific details. In other instances, well-known structures and devices are shown schematically to simplify the drawings.

Figure 2:
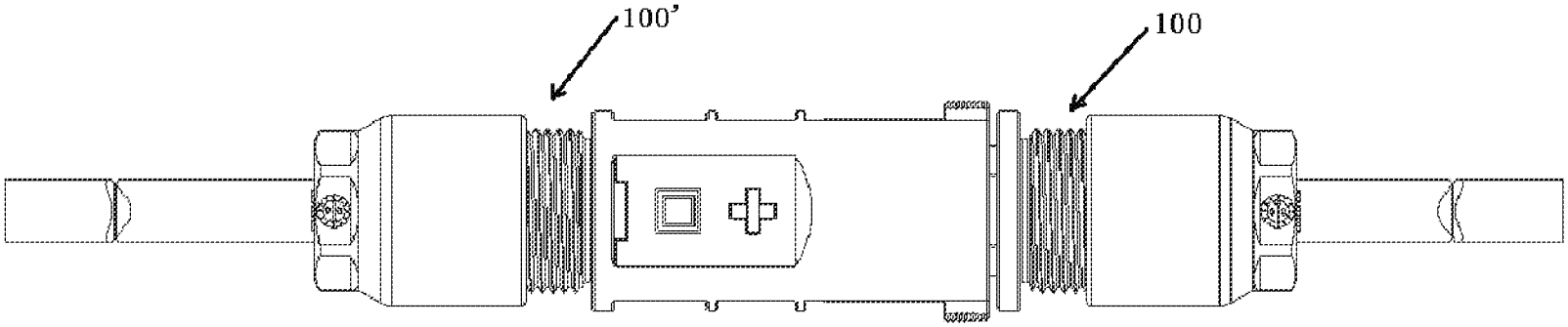
FIG. 2 is a front view of the electrical connector assembly.
Figure 3:
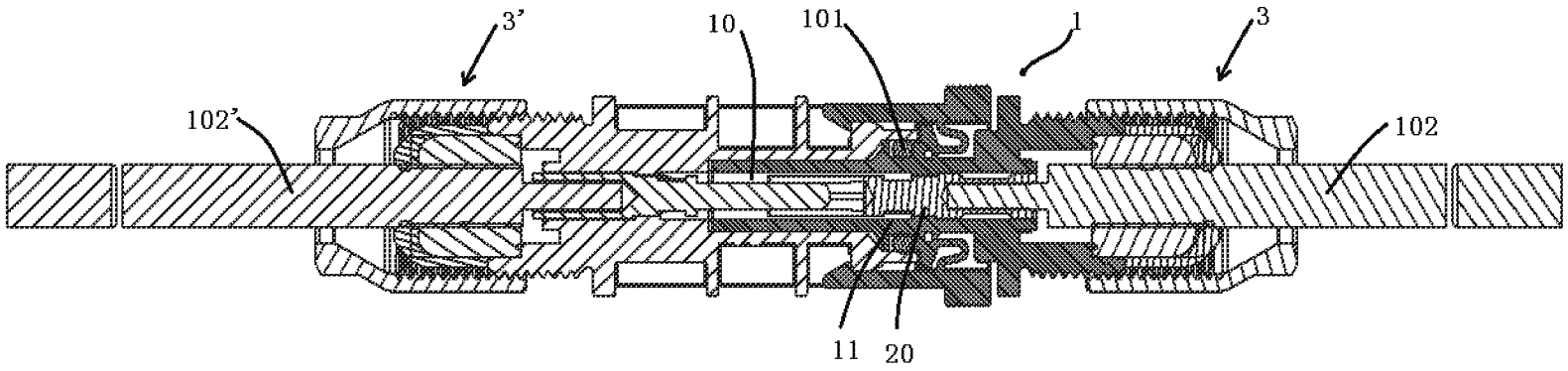
FIG. 3 is a sectional front view of the electrical connector assembly.

An electrical connector assembly according to an embodiment is shown in FIGS. 1-3. The electrical connector assembly includes an electrical connector 100 matable with a mating electrical connector 100'.

The electrical connector 100, as shown in FIGS. 3, 4, and 7-9, includes a housing 1 made of an insulation material, a conductive terminal 20 received in the housing 1, and a locking device 12. The housing 1 includes a cylinder 11, in which a receiving passage 10 extending in an axial direction of the electrical connector 100 is formed. The conductive terminal 20 is adapted to be received in the receiving passage 10. In an embodiment, the electrical connector 100 is a coaxial connector.

As shown in FIG. 3, a mating conductive terminal of the mating electrical connector 100' is inserted into the receiving passage 10 formed in the cylinder 11 to form an electrical connection between the conductive terminal 20 and the mating conductive terminal. In other embodiments, other housing structures of the electrical connector 100 and other insertion and fitting ways thereof may be used as long as the conductive terminals are electrically connected.

Figure 4:
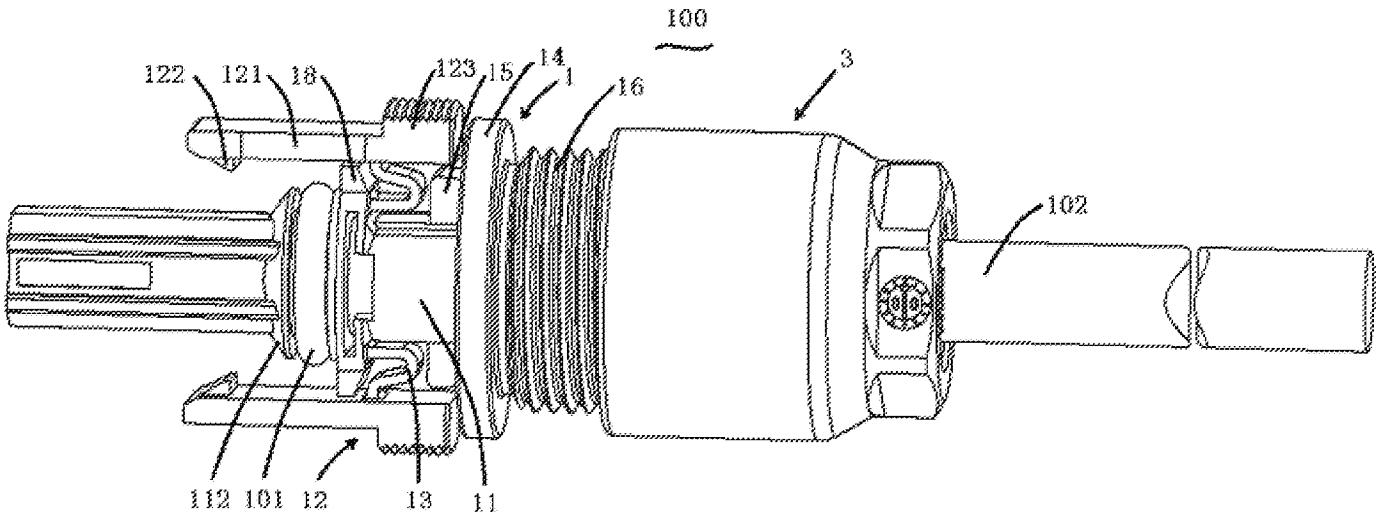
FIG. 4 is a perspective view of an electrical connector of the electrical connector assembly.
Figure 5:
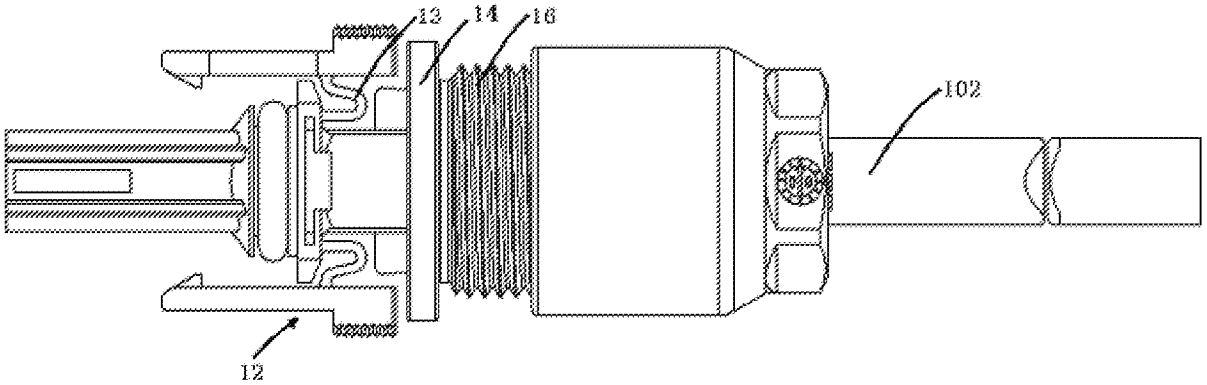
FIG. 5 is a front view of the electrical connector.

The locking device 12, as shown in FIG. 4, includes a body portion 121, a locking portion 122 disposed at a first end of the body portion 121, a releasing portion 123 disposed at a second end of the body portion 121 opposite the first end, and a flexible connecting arm 13 formed in a curved shape and configured to connect the body portion 121 to an outer surface of the cylinder 11. The locking portion 122 is configured to be engaged with a mating locking portion of the mating electrical connector 100' to lock the electrical connector 100 with the mating electrical connector 100'. The releasing portion 123 is configured to release the engagement between the locking portion 122 and the mating locking portion.

The flexible connecting arm 13, as shown in FIGS. 4-6, 8, and 9, is formed in a curved shape. An impact on the connecting arm 13 and thus the entire locking device 12 is buffered due to the curved shape. A failure situation, such as a breakage of the connecting arm 13 and an inability of the connecting arm 13 to resiliently rebound, a breakage of the body portion 121 or the locking portion 122 of the locking device 12, and an inability of the locking device 12 to perform locking or unlocking operation due to severe deformation thereof, may be prevented.

Figure 8:
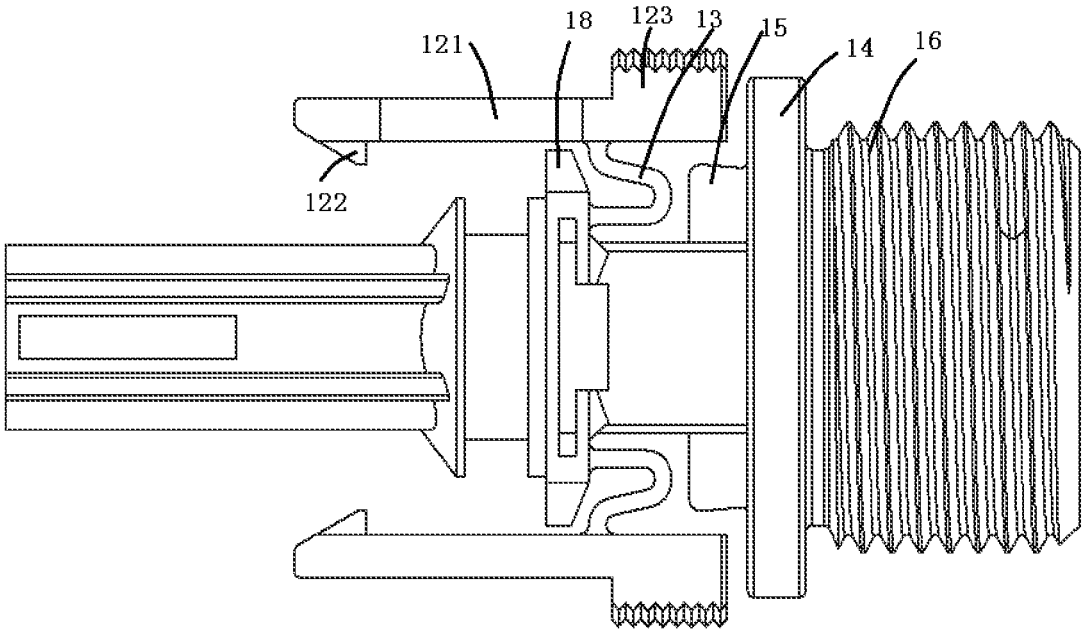
FIG. 8 is a front view of the housing.
Figure 9:
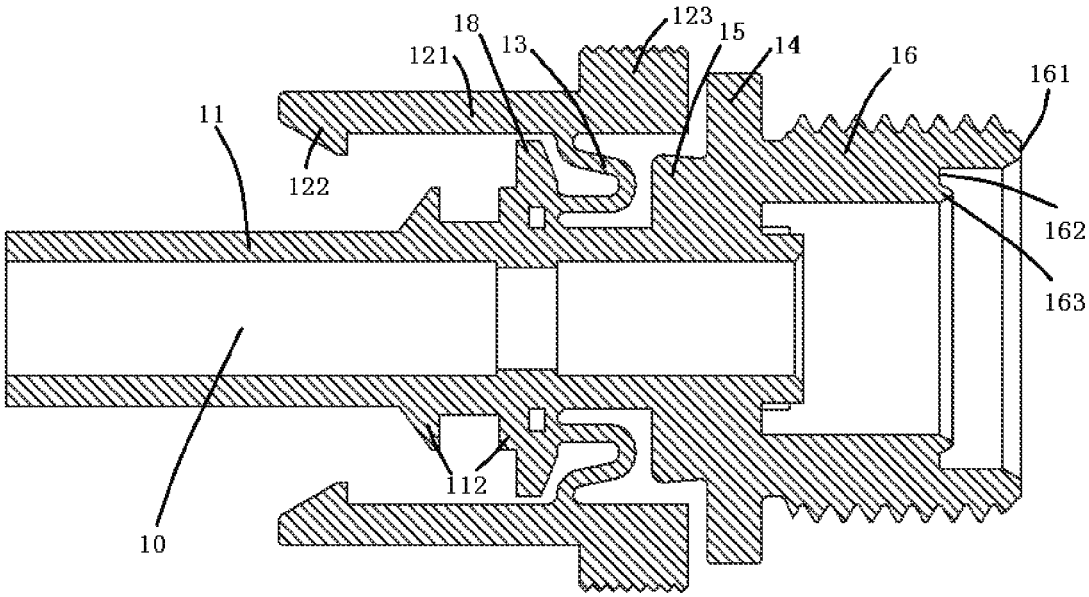
FIG. 9 is a sectional front view of the housing.

The flexible connecting arm 13 is formed in a substantially U-shape in the embodiment shown in FIGS. 4, 8, and 9. Two side arms of the substantially U-shaped connecting arm 13 are substantially parallel to an axial direction of the connector 100. The U-shape, however, is only one exemplary embodiment of a curved shape of the flexible connecting arm 13. In other embodiments, the flexible connecting arm 13 may be formed in a W-shape, a parabolic shape, or a spiral shape as long as a soft cushioning effect may be achieved.

Figure 6:
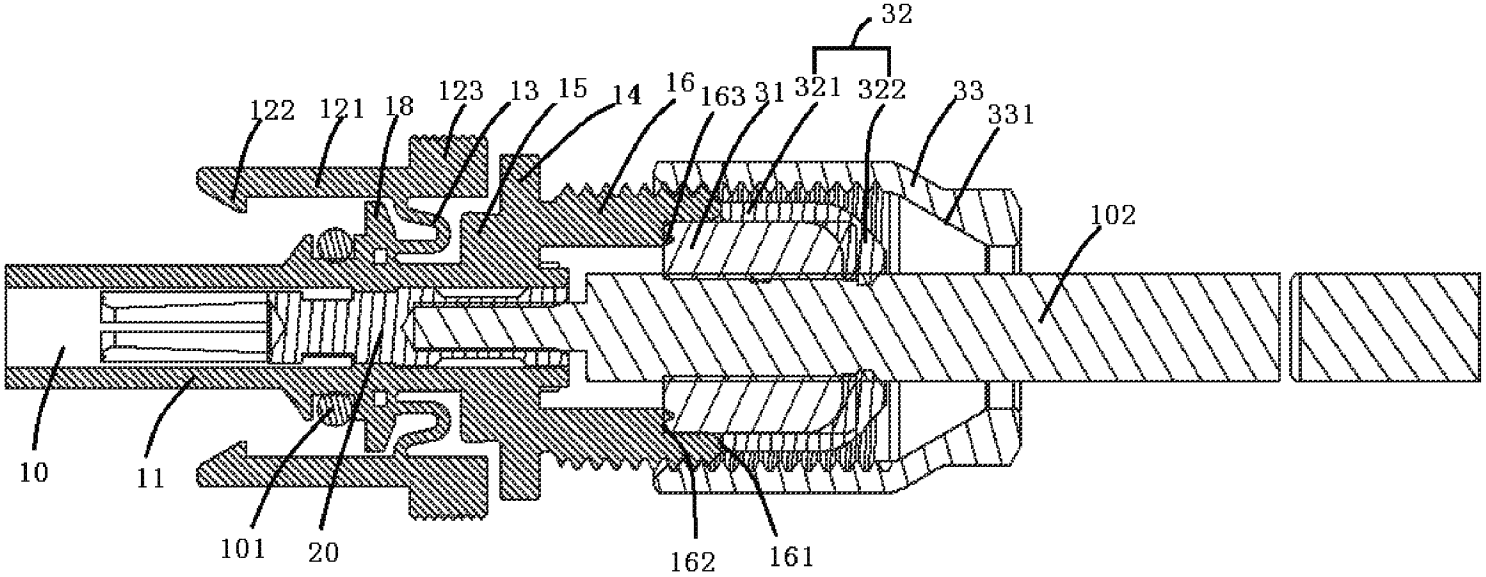
FIG. 6 is a sectional front view of the electrical connector.

The housing 1, as shown in FIGS. 6, 8, and 9, further includes a first stopping portion 15. At least a portion of the first stopping portion 15 is located between the releasing portion 123 and the cylinder 11 in a radial direction of the connector 100 perpendicular to the axial direction. The first stopping portion 15 prevents excessive displacement of the releasing portion 123 in a radial inward direction. At least a portion of the first stopping portion 15 faces an inner side of the releasing portion 123 and protrudes outwards from an outer surface of the cylinder 11 so as to prevent excessive displacement of the releasing portion 123 in the radial inward direction. In a case where the locking device 12 is subject to an impact and the releasing portion 123 is radially displaced inwards, the releasing portion 123 abuts against the first stopping portion 15 when moved to a certain degree, such that a further displacement of the radiating portion 123 in the radial inward direction is prevented, thereby preventing breakage of the releasing portion 123 and excessive deformation of the locking device 12.

The arrangement of the first stopping portion 15 is not limited to the illustrated manner of projecting outwards from the outer surface of the cylinder 11. In other embodiments, the first stopping portion 15 projects from a first flange 14 which is located at the right side of the first stopping portion 15, as shown in FIGS. 4 and 6. The first stopping portion 15 position may vary as long as at least a portion thereof is located between the releasing portion 123 and the cylinder 11 in the radial direction and the releasing portion 123 may be made to abut against the first stopping portion 15. Alternatively, the first stopping portion may be formed by protruding from a bottom surface of the releasing portion 123, and when the locking device 12 is subject to an impact and the releasing portion 123 is radially displaced inwards, the first stopping portion 15 is driven to abut against the cylinder 11 so as to prevent a further displacement of the releasing portion 123.

The housing 1, as shown in FIGS. 6, 8, and 9, further includes a second stopping portion 18 located between the locking portion 122 and the flexible connecting arm 13 in the axial direction and located between the body portion 121 and the cylinder 11 in the radial direction. The second stopping portion 18 prevents excessive displacement of the body portion 121 in the radially inward direction. In a case where the locking device 12 is subject to an impact and the body portion 121 is displaced radially inwards, the body portion 121 abuts against the second stopping portion 18 when moved to a certain degree, so that a further displacement of the body portion 121 is prevented, thereby preventing the inability of the locking device 12 to rebound due to excessive deformation thereof and the breakage of flexible connecting arm 13.

The formation of the second stopping portion 18 is not limited to the illustrated manner of protruding outwards from the outer surface of the cylinder 11. The second stopping portion 18 may be formed extending from a variety of elements as long as at least a portion of the second stopping portion 18 is located between the body portion 121 and the cylinder 11 in the radial direction, avoiding excessive displacement of the body portion 121 in the radial inward direction.

As shown in FIG. 9, a free end of the second stopping portion 18 extends further in the radial direction than the side arms of the connecting arm 13. The free end of the second stopping portion 18 is positioned to prevent displacement of the side arms of the connecting arm 13 in the axial direction. The second stopping portion 18 is therefore arranged to not only prevent excessive displacement of the body portion 121 of the locking device in the radial direction, but also to prevent the excessive displacement of the flexible connecting arm 13 in the axial forward direction, further protecting the flexible connecting arm 13 from potential damage due to impact.

Figure 7:
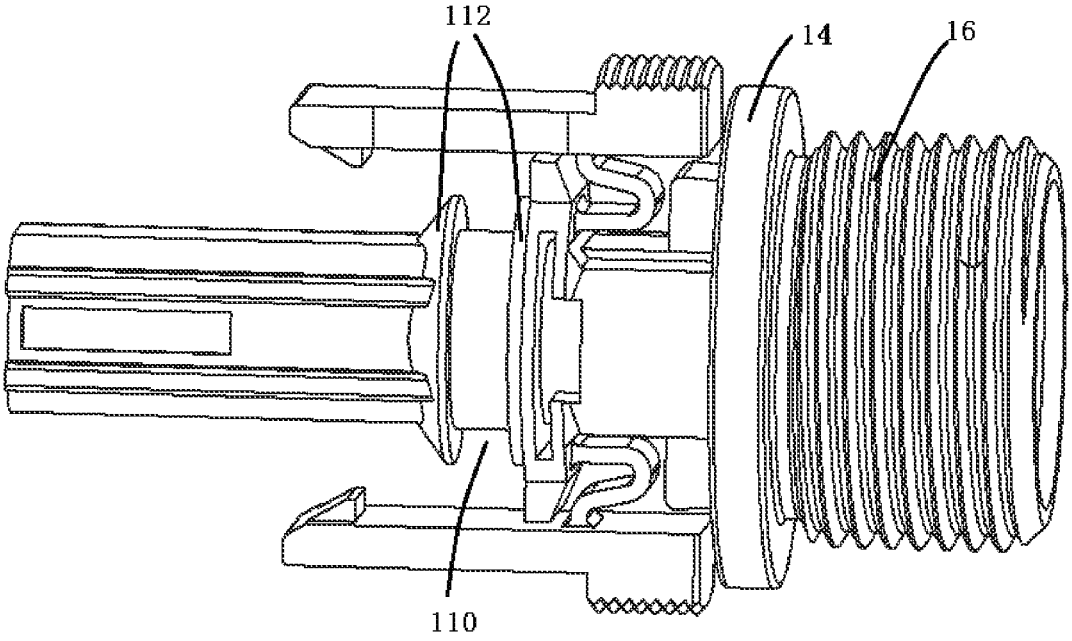
FIG. 7 is a perspective view of a housing of the electrical connector.

The electrical connector 100, as shown in FIGS. 3 and 4, further includes a seal ring 101 sleeved on the cylinder 11. The seal ring 101 is adapted to be pressed between an inner wall of a housing of the mating electrical connector 100' and the cylinder 11 of the electrical connector 100 so as to seal a mating interface between the mating electrical connector 100' and the cylinder 11 of the electrical connector 100. A first protrusion 112 is formed on an outer surface of the cylinder 11 and is located in front of the second stopping portion 18 in the axial direction, as shown in FIGS. 4, 7, and 9. An annular groove 110 is formed in the first protrusion 112 and the seal ring 101 is received in the annual groove 110.

The housing 1, as shown in FIG. 6, includes the first flange 14 protruding outwards in the radial direction from a rear end of the cylinder 11 and a connecting portion 16 extending rearwards in the axial direction perpendicular to the first flange 14. External threads are formed on an outer surface of the connecting portion 16.

The electrical connector 100, as shown in FIGS. 3 and 6, includes a cable 102, a conductor of the cable 102 adapted to be inserted into the conductive terminal 20, and a fastening and seal assembly 3 adapted to be engaged with the connecting portion 16 to fasten the cable 102 in the electrical connector 100 and seal a rear end of the electrical connector 100. The fastening and seal assembly 3 includes: a sealing member 31 sleeved on the cable 102 and adapted to press the cable 102, a clamping member 32 sleeved around the sealing member 31 and adapted to clamp the cable 102 and the sealing member 31, and a nut 33 threaded to the connecting portion 16. An inner surface of the nut 33 is adapted to press against the clamping member 32.

The clamping member 32, as shown in FIG. 6, includes an annular body portion 321 and a plurality of clamping jaws 322 extending from an axial rear end of the annular body portion 321 and separated from one another. A tip end of the clamping jaw 322 abuts against the cable 102 in the radial direction. The inner surface of the nut 33 includes a tapered surface 331 formed at a rear portion of the inner surface and gradually pressing the clamping jaw 322 while the nut 33 is screwed onto the connecting portion 16.

The connecting portion 16, as shown in FIG. 6, includes a first end face 161 formed at an axial rear end of the connecting portion 16. The first end face 161 is adapted to abut against an axial front end of the annular body portion 321. The connecting portion 16 further includes a second end face 162 formed at an inner side of the axial rear end of the connecting portion 16 and adapted to abut against an axial front end of the sealing member 31. An annular protrusion 163 is formed on the second end face 162 and adapted to be pressed into the sealing member 31 when mounting the nut 33 on the connecting portion 16.

The mating electrical connector 100', as shown in FIGS. 1-3, includes a housing 1' including a mating locking portion that is mated with the locking portion 122 of the electrical connector 100. The mating electrical connector 100' further includes a fastening and seal assembly 3' adapted to be engaged with the housing 1' to fasten the cable 102' to the mating electrical connector 100' and simultaneously seal the rear end of the mating electrical connector 100'.

A process of assembling the electrical connector 100 is described below:

First, stripping the cable 102 to expose a conductor thereof, and crimping the conductive terminal 20 onto the conductor;

Second, sleeving the sealing member 31, the clamping member 32, and the nut 33 on the cable 102;

Third, inserting the conductive terminal 20 into the receiving passage 10 of the cylinder 11;

Fourth, screwing the internal thread of the nut 33 onto the external thread of the connecting portion 16. As the nut 33 is gradually screwed, the inclined surface 331 of the inner surface of the nut 33 that is matched with the clamping jaw 322 of the clamping member 32 gradually comes into contact with and abuts against the clamping jaw 322 such that the clamping jaw 322 is gradually pressed.

Finally, when the nut is fully screwed, the sealing member 31 is clamped, and the tip end of the clamping jaw 322 is perpendicularly abutted against the cable 102 while clamping the cable 102. Simultaneously, the first end face 161 of the connecting portion 16 abuts against the front end of the annular body portion 321, and the second end face 162 thereof abuts against the front end of the sealing member 31 while the annular protrusion 163 is pressed into the sealing member 31. Both good sealing of the conductive terminal 20 of the connector 100 and the clamping of the cable 102 are thereby achieved.

What is claimed is:

1. An electrical connector adapted to be mated with a mating electrical connector, comprising:

a housing including a cylinder having a receiving passage extending in an axial direction of the electrical connector;

a conductive terminal disposed in the receiving passage; and a locking device including:

(a) a body portion;

(b) a locking portion disposed at a first end of the body portion and configured to engage with a mating locking portion of the mating electrical connector to lock the electrical connector with the mating electrical connector;

(c) a releasing portion disposed at a second end of the body portion opposite the first end of the body portion and configured to release the engagement between the locking portion and the mating locking portion; and (d) a flexible connecting arm formed in a curved shape and connecting the body portion to an outer surface of the cylinder;

wherein the housing includes a first flange protruding outwards from a rear end of the cylinder and a connecting portion extending rearwards in the axial direction perpendicular to the first flange, a plurality of external threads are formed on an outer surface of the connecting portion.

2. The electrical connector of claim 1, wherein the electrical connector is a coaxial connector.

3. The electrical connector of claim 1, wherein the housing includes a first stopping portion, at least a portion of the first stopping portion is between the releasing portion and the cylinder in a radial direction of the electrical connector perpendicular to the axial direction of the electrical connector, the first stopping portion configured to prevent excessive displacement of the releasing portion in a radial inward direction.

4. The electrical connector of claim 3, wherein the housing includes a second stopping portion between the locking portion and the flexible connecting arm in the axial direction and between the body portion and the cylinder in the radial direction, the second stopping portion configured to prevent excessive displacement of the body portion in the radial inward direction.

5. The electrical connector of claim 1, wherein the flexible connecting arm is formed in a U-shape, a pair of side arms of the U-shape are parallel to the axial direction.

6. The electrical connector of claim 5, further including a second stopping portion and wherein a free end of the second stopping portion extends outward in the radial direction further than the pair of side arms and is configured to prevent excessive displacement of the pair of side arms in the axial direction.

7. The electrical connector of claim 1, further comprising a seal ring sleeved on the cylinder and pressed between an inner wall of a housing of the mating electrical connector and the cylinder to seal a mating interface between the mating electrical connector and the cylinder.

8. The electrical connector of claim 7, wherein an annular groove is formed in an outer surface of the cylinder in front of the second stopping portion in the axial direction, the seal ring is disposed in the annular groove.

9. The electrical connector of claim 1, further comprising a cable having a conductor inserted into the conductive terminal.

10. The electrical connector of claim 9, further comprising a fastening and seal assembly engaged with the connecting portion to fasten the cable into the electrical connector and seal a rear end of the electrical connector.

11. The electrical connector of claim 10, wherein the fastening and seal assembly includes:

a sealing member sleeved on the cable to press the cable;

a clamping member sleeved around the sealing member to clamp the cable and the sealing member; and a nut threaded to the connecting portion, an inner surface of the nut adapted to press against the clamping member.

12. The electrical connector of claim 11, wherein the clamping member includes an annular body portion and a plurality of clamping jaws extending from a rear end of the annular body portion and separated from one another, a tip end of each clamping jaw abutting against the cable.

13. The electrical connector of claim 12, wherein the inner surface of the nut has a tapered surface at a rear portion of the inner surface adapted to cooperate with the clamping jaws to gradually press the clamping jaws while screwing the nut onto the connecting portion.

14. The electrical connector of claim 13, wherein the connecting portion includes a first end face formed at a rear end of the connecting portion and abutting against a front end of the annular body portion.

15. The electrical connector of claim 14, wherein the connecting portion includes a second end face formed at an inner side of the rear end of the connecting portion and abutting against a front end of the sealing member.

16. The electrical connector of claim 15, wherein the second end face has an annular protrusion adapted to be pressed into the sealing member when mounting the nut on the connecting portion.

17. An electrical connector assembly, comprising:

an electrical connector, comprising:

a housing including a cylinder having a receiving passage extending in an axial direction of the electrical connector;

a conductive terminal disposed in the receiving passage and having a cable having a conductor inserted into the conductive terminal; and a locking device including:

(a) a body portion;

(b) a locking portion disposed at a first end of the body portion;

(c) a releasing portion disposed at a second end of the body portion opposite the first end of the body portion; and (d) a flexible connecting arm formed in a curved shape and connecting the body portion to an outer surface of the cylinder; and a mating electrical connector having a mating locking portion engaging the locking portion of the electrical connector to lock the electrical connector with the mating electrical connector, the releasing portion configured to release the engagement between the locking portion and the mating locking portion;

wherein the housing includes a first flange protruding outwards from a rear end of the cylinder and a connecting portion extending rearwards in the axial direction perpendicular to the first flange, a plurality of external threads are formed on an outer surface of the connecting portion.

18. The electrical connector of claim 17, further comprising a sealing member sleeved on the cable, and a clamping member sleeved around the sealing member, and a nut threaded to the connecting portion, an inner surface of the nut adapted to press against the clamping member to clamp the cable and the sealing member and thereby fasten the cable into the electrical connector and seal a rear end of the electrical connector.

19. The electrical connector of claim 18, wherein the clamping member includes an annular body portion and a plurality of clamping jaws extending from a rear end of the annular body portion and separated from one another, a tip end of each clamping jaw abutting against the cable.

20. The electrical connector of claim 19, wherein the inner surface of the nut has a tapered surface at a rear portion of the inner surface adapted to cooperate with the clamping jaws to gradually press the clamping jaws while screwing the nut onto the connecting portion.

* * * * *